US011067355B2

(12) United States Patent
McPherson

(10) Patent No.: US 11,067,355 B2
(45) Date of Patent: Jul. 20, 2021

(54) ARCHERY BOW CABLE MOUNTED PROTECTOR

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 179 days.

(21) Appl. No.: 14/725,262

(22) Filed: May 29, 2015

(65) Prior Publication Data

US 2015/0345891 A1 Dec. 3, 2015

Related U.S. Application Data

(63) Continuation-in-part of application No. 29/518,045, filed on Feb. 19, 2015, now Pat. No. Des. 753,605.

(60) Provisional application No. 62/005,913, filed on May 30, 2014.

(51) Int. Cl.
*F41B 5/14* (2006.01)
*F41B 5/10* (2006.01)

(52) U.S. Cl.
CPC ..... *F41B 5/1403* (2013.01); *F41B 5/10* (2013.01); *F41B 5/1411* (2013.01)

(58) Field of Classification Search
CPC ..... F41B 5/10; F41B 5/1403; F41B 5/1469; F41B 5/1411; F41B 5/1407; F41B 5/1434; F41B 5/1484; F41B 5/00; F41B 5/12; F41B 3/02
See application file for complete search history.

(56) References Cited

U.S. PATENT DOCUMENTS

| | | | | | |
|---|---|---|---|---|---|
| D27,931 | S | | 12/1897 | Eaton | |
| D33,108 | S | | 8/1900 | Eaton | |
| 1,044,412 | A | | 11/1912 | Newton | |
| 1,211,480 | A | | 1/1917 | Newton | |
| 1,232,000 | A | | 7/1917 | Chase | |
| 1,354,469 | A | | 10/1920 | Joseph | |
| 1,918,652 | A | | 7/1933 | Marbach | |
| D123,490 | S | | 11/1940 | Saffell | |
| 2,326,693 | A | | 8/1943 | Sindler | |
| 2,617,402 | A | * | 11/1952 | Roemer | F41B 5/14 124/23.1 |
| 2,650,400 | A | * | 9/1953 | Loyal | H01B 17/22 24/115 H |
| 2,777,437 | A | | 1/1957 | Allen | |
| 2,910,058 | A | | 10/1959 | Bender | |
| 2,956,560 | A | * | 10/1960 | Stockfleth | F41B 5/14 124/90 |
| 3,010,447 | A | | 11/1961 | Roemer | |
| 3,059,370 | A | | 10/1962 | Moore | |
| 3,059,629 | A | | 10/1962 | Stinson | |
| 3,331,720 | A | * | 7/1967 | Watson | F41B 5/1411 156/86 |
| 3,340,862 | A | | 9/1967 | Saunders | |
| 3,375,815 | A | * | 4/1968 | Novak | F41B 5/1415 124/23.1 |

(Continued)

*Primary Examiner* — Melba Bumgarner
*Assistant Examiner* — Amir A Klayman
(74) *Attorney, Agent, or Firm* — Laabs Intellectual Property

(57) ABSTRACT

In some embodiments, an archery bow comprises a rotatable member and at least one cable segment. A protector is supported by the cable segment. The protector is arranged to prevent the rotatable member from contacting the cable segment.

22 Claims, 6 Drawing Sheets

(56) References Cited

U.S. PATENT DOCUMENTS 3,507,525 A * 4/1970 Sable ..... E21B 37/02 403/372
3,576,304 A * 4/1971 Gillemot ..... F16L 3/1226 24/306
3,584,615 A 6/1971 Stinson
3,588,963 A 6/1971 Moberg
3,597,803 A 8/1971 Van Neil
3,612,029 A * 10/1971 Carroll ..... F41B 5/1407 124/92
3,658,157 A 4/1972 Lee
D226,429 S 3/1973 Christen
3,756,214 A 9/1973 Christen
3,756,215 A 9/1973 Black
3,757,761 A 9/1973 Izuta
3,802,411 A * 4/1974 Manspeaker ..... F41B 5/0005 124/90
3,837,327 A 9/1974 Saunders et al.
3,937,205 A 2/1976 Saunders
4,023,551 A 5/1977 Huddleston
4,050,334 A 9/1977 Davis, Jr.
4,054,121 A 10/1977 Hoyt, Jr.
4,061,125 A 12/1977 Trotter
4,074,409 A * 2/1978 Smith ..... F41B 5/1449 124/23.1
4,079,722 A 3/1978 Griggs
4,080,951 A 3/1978 Bateman, III
D266,179 S 9/1982 Peck
4,377,152 A 3/1983 Saunders
RE31,541 E 3/1984 Wood
4,461,267 A 7/1984 Simonds et al.
4,524,750 A * 6/1985 Darlington ..... 124/25.6
4,628,892 A 12/1986 Windedahl et al.
4,656,994 A * 4/1987 Jenks ..... F41B 5/1415 124/23.1
4,909,233 A 3/1990 Stephenson
4,919,108 A * 4/1990 Larson ..... F41B 5/10 124/25.6
4,940,856 A * 7/1990 Bock ..... H01R 4/186 174/84 C
5,002,035 A 3/1991 Brooks
5,010,622 A 4/1991 Morita
5,016,602 A 5/1991 Mizek
5,016,604 A 5/1991 Tilby
D322,022 S 12/1991 Cunningham et al.
5,079,804 A 1/1992 Gregurich et al.
5,178,122 A 1/1993 Simonds
D343,234 S 1/1994 Williams
D344,123 S 2/1994 Bertram
5,287,842 A * 2/1994 Saunders ..... F41B 5/14 124/91
D346,423 S 4/1994 Kitagawa
5,320,085 A 6/1994 Hanneman
5,323,756 A 6/1994 Rabska
5,331,725 A * 7/1994 Chou ..... E04H 17/18 24/339
5,368,006 A 11/1994 McPherson
5,390,657 A 2/1995 Larson
5,392,757 A 2/1995 Head et al.
5,450,673 A 9/1995 Denton
5,452,704 A 9/1995 Winebarger
5,531,211 A 7/1996 Wilfong, Jr.
5,535,731 A 7/1996 Webster
5,606,963 A 3/1997 Wenzel et al.
5,649,527 A 7/1997 Olsen et al.
5,680,851 A 10/1997 Summers
5,715,578 A 2/1998 Knudson
5,720,269 A 2/1998 Saunders
D410,272 S 5/1999 Fitzgerald, Jr.
5,975,070 A 11/1999 Sands
5,992,403 A 11/1999 Slates
RE36,555 E 2/2000 Tentler
6,044,528 A 4/2000 Putney
D426,612 S 6/2000 Primeau, IV
6,092,516 A 7/2000 Martin et al.
6,237,584 B1 5/2001 Sims
6,257,220 B1 7/2001 McPherson et al.
6,298,842 B1 10/2001 Sims
6,382,201 B1 5/2002 McPherson et al.
6,412,586 B1 7/2002 Askew
6,425,385 B1 7/2002 Gallops, Jr.
6,443,139 B1 9/2002 McPherson
6,446,620 B1 9/2002 Summers et al.
6,634,348 B2 10/2003 Gallops, Jr.
6,651,362 B2 * 11/2003 Caveney ..... G09F 3/02 40/316
6,651,641 B1 * 11/2003 Bower ..... F41B 5/123 124/25
6,679,242 B1 * 1/2004 Martin ..... F41B 5/1426 124/90
6,681,755 B2 1/2004 Pujos
6,745,757 B2 6/2004 Sims
6,761,158 B2 * 7/2004 Wright ..... F41B 5/1407 124/92
6,802,307 B2 10/2004 Leven
D503,769 S 4/2005 Korn et al.
6,966,314 B2 * 11/2005 McPherson ..... F41B 5/105 124/25.6
7,082,937 B1 8/2006 Land
D546,659 S 7/2007 Smith
7,264,098 B2 9/2007 McPherson
D584,134 S 1/2009 Lee
D600,773 S 9/2009 Hall
7,721,724 B2 5/2010 Goade
7,753,044 B2 7/2010 Goade
7,793,646 B2 9/2010 Cooper et al.
D627,460 S 11/2010 Horton
D628,669 S 12/2010 McPherson
D628,670 S 12/2010 McPherson
D629,896 S 12/2010 Horton
7,954,481 B2 6/2011 Barnard
8,020,544 B2 9/2011 McPherson et al.
D650,036 S 12/2011 McPherson
D669,392 S * 10/2012 Dunn ..... D11/184
8,408,195 B2 4/2013 McPherson
8,448,633 B2 5/2013 McPherson
8,839,777 B1 * 9/2014 Webb ..... F41B 5/1407 124/92
8,850,675 B2 10/2014 Frydlewski
9,068,791 B2 * 6/2015 McPherson ..... F41B 5/123
9,228,791 B2 * 1/2016 Saunders ..... F41B 5/1426
9,250,031 B2 2/2016 McPherson
2002/0162199 A1 11/2002 Notomi
2003/0168051 A1 * 9/2003 Andrews ..... 124/25.6
2004/0077440 A1 * 4/2004 Kronfeld ..... F41B 5/1426 473/578
2006/0011190 A1 1/2006 Andrews
2006/0180135 A1 8/2006 Andrews
2008/0264400 A1 10/2008 Wright
2009/0071458 A1 3/2009 Gordon et al.
2009/0107474 A1 4/2009 Silverson
2009/0133683 A1 5/2009 Wright
2010/0319670 A1 12/2010 Sims et al.
2011/0011385 A1 * 1/2011 Grace, Jr. ..... F41B 5/10 124/25.6
2013/0341061 A1 * 12/2013 Kaihotsu ..... H02G 3/0475 174/68.3

* cited by examiner

ARCHERY BOW CABLE MOUNTED PROTECTOR

CROSS-REFERENCE TO RELATED APPLICATIONS

This application claims the benefit of U.S. patent application Ser. No. 62/005,913, filed May 30, 2014, the entire content of which is hereby incorporated by reference. This application also claims the benefit of U.S. patent application Ser. No. 29/518,045, filed Feb. 19, 2015, the entire content of which is hereby incorporated by reference.

BACKGROUND OF THE INVENTION

This invention relates generally to archery bows and more specifically to cable and string protectors for archery bows.

Archery bows are known in the art. Some archery bows are compound bows, which typically use rotatable members, at least one cam and cable arrangements to reduce the holding weight of the bow in a drawn condition.

When a cable or string of an archery bow is positioned directly adjacent another portion of the bow, the cable or string can contact the portion of the bow. For example, a portion of a cable can contact a rotatable member. As the bow is drawn, repeated contact over time can cause wear to a surface of the cable.

There remains a need for novel bow and cable designs that can prevent a bowstring or cable from directly contacting other portions of the bow. There remains a need for novel bow designs that provide greater longevities than prior bows.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a rotatable member and at least one cable segment. A protector is supported by the cable segment. The protector is arranged to prevent the rotatable member from contacting the cable segment.

In some embodiments, the protector contacts the rotatable member.

In some embodiments, the protector comprises a plurality of outer sides.

In some embodiments, the protector comprises a cavity having an opening that extends an entire length of the protector. In some embodiments, the protector can be attached to a cable segment by passing the cable segment through the opening while resiliently deforming the protector and/or the cable segment.

In some embodiments, an archery bow comprises a riser, a first limb supporting a first rotatable member and a second limb supporting a second rotatable member. A bowstring extends between the rotatable members, and a cable segment extends between the rotatable members. A protector is supported by the cable segment. The protector is arranged to prevent the cable segment from contacting the first rotatable member.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
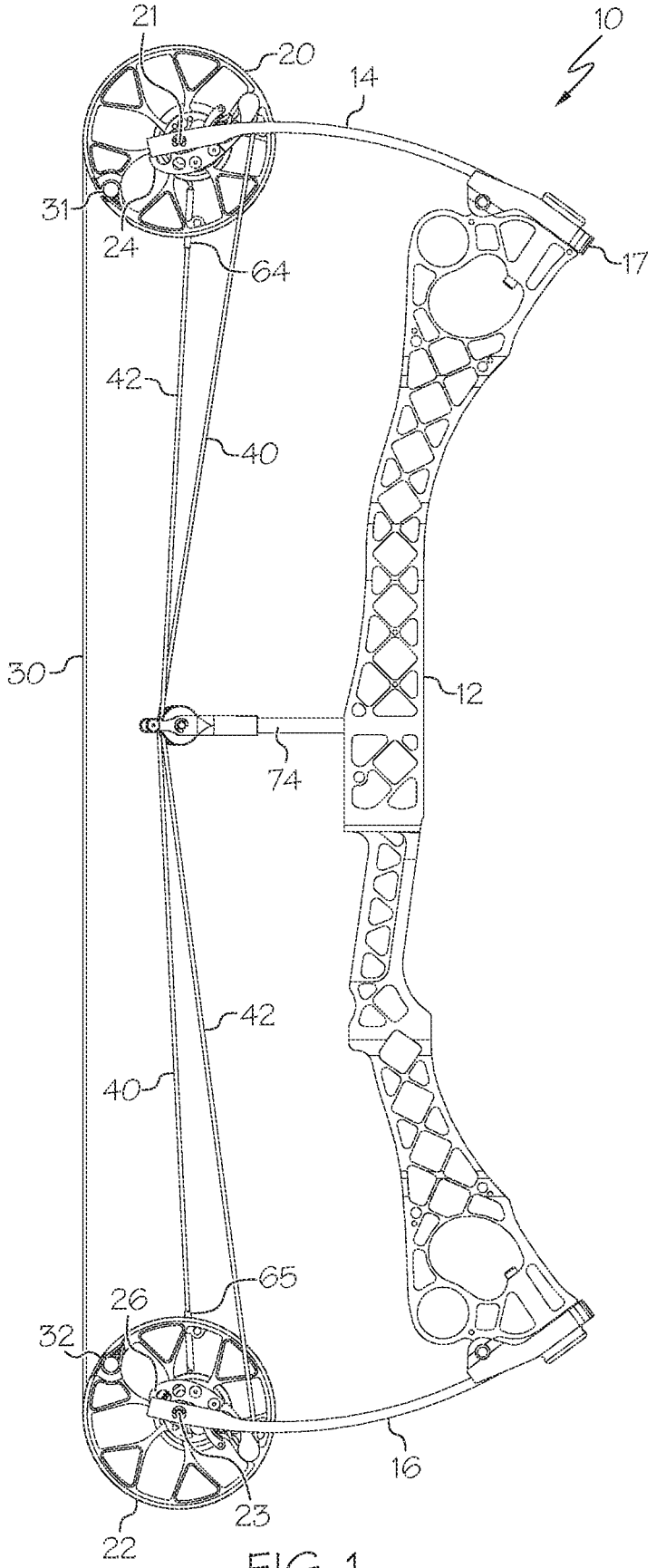
FIG. 1 shows an embodiment of a bow in a brace condition.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10 in a brace condition. In some embodiments, a bow 10 comprises a riser 12 and at least one limb 14 supported by the riser 12. As shown in FIG. 1, the riser 12 supports a first limb 14 at one end and a second limb 16 at the other end. In some embodiments, a limb cup 17 can be used to receive a limb 14. In some embodiments, a limb cup 17 comprises a device as disclosed in U.S. Pat. No. 8,453,635, the entire disclosure of which is hereby incorporated herein by reference.

Desirably, a limb 14 supports at least one rotatable member 20. As shown in FIG. 1, the first limb 14 supports a first rotatable member 20 and the second limb 16 supports a second rotatable member 22. In some embodiments, the first limb 14 supports a first axle 21, and the first axle 21 supports the first rotatable member 20. Similarly, the second limb 16 can support a second axle 23, which in turn supports the second rotatable member 22.

Desirably, a bowstring 30 extends between the first rotatable member 20 and the second rotatable member 22. In some embodiments, a first end 31 of the bowstring 30 is anchored to the first rotatable member 20 and a second end 32 of the bowstring 30 is anchored to the second rotatable member 22. In some embodiments, a segment of the bowstring 30 extends about a periphery of a rotatable member 20 when the bow 10 is in the brace condition.

In some embodiments, the first rotatable member 20 comprises a first cam portion 24 defining a first cam track, and the second rotatable member 22 comprises a second cam portion 26 defining a second cam track. In some embodiments, a first power cable 40 is attached to the first rotatable member 20 and arranged to be taken up by the first cam track when the bow 10 is drawn. In some embodiments, a second power cable 42 is attached to the second rotatable member 22 and arranged to be taken up by the second cam track when the bow 10 is drawn. In some embodiments, the first power cable 40 is anchored to the second axle 23 and the second power cable 42 is anchored to the first axle 21 (not shown). As shown in FIG. 1, the first power cable 40 is anchored to the second rotatable member 22 and the second power cable 42 is anchored to the first rotatable member 20.

In some embodiments, the power cable 40, 42 anchors comprise force vectoring anchors, for example as described in U.S. Pat. Nos. 7,946,281 and 8,020,544, the entire disclosures of which are hereby incorporated herein by reference.

Although FIG. 1 shows a two-cam compound bow, the claimed invention can be used with any suitable type of bow, such as single-cam bows, 1.5 cam bows, etc. A two-cam bow typically comprises two power cables. A single-cam bow and a 1.5 cam bow typically comprise one power cable and a secondary harness cable often called a control cable.

In some embodiments, a bow 10 comprises a cable guard 74 arranged to bias one or more cables (e.g. 40, 42) laterally.

Desirably, a bow 10 comprises a protector 64 that is attached to a cable (e.g. 40 or 42) or bowstring 30. Desirably, the protector 64 is arranged to prevent bow structure adjacent to the cable 42 from contacting the cable 42. Desirably, a protector 64 at least partially surrounds the cable 40, 42 or bowstring 30 that it protects. In some embodiments, a protector fully surrounds the cable 40, 42 or bowstring 30 that it protects. In some embodiments, the protector 64 is supported by the cable 40, 42 or bowstring 30 that it protects.

In some embodiments, a bow 10 comprises a first protector 64 arranged to protect one cable 42 and a second protector 65 arranged to protect another cable 40.

Figure 2:
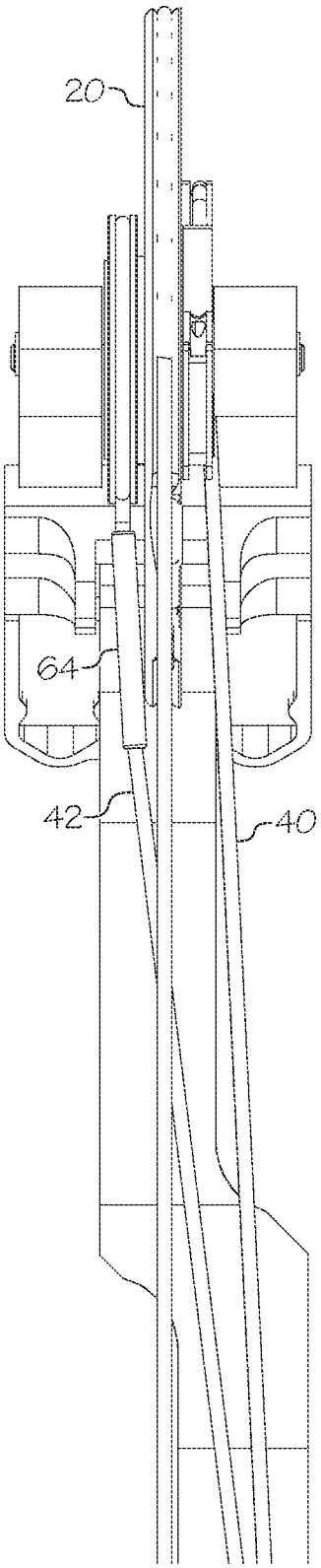
FIG. 2 shows a portion of an embodiment of a bow and an embodiment of a cable mounted protector.

FIG. 2 shows a portion of the bow 10 of FIG. 1 from the back, for example from an archer's vantage point. Due to the angle of the power cables 40, 42 in the bow, portions of the power cables 40, 42 may be biased to contact a rotatable member 20. Desirably, a protector 64 is arranged to prevent contact between the cable 42 and an adjacent structure, such as a rotatable member 20. In some embodiments, a cable protector 64 comprises a barrier located between a cable 42 and a rotatable member 20.

In some embodiments, the protector 64 is arranged to contact a rotatable member 20 during at least a portion of the draw cycle. In some embodiments, the protector 64 contacts the rotatable member 20 at brace condition. In some embodiments, the protector 64 contacts the rotatable member 20 at full draw. In some embodiments, the protector 64 contacts the rotatable member 20 throughout the draw cycle.

Figure 3:
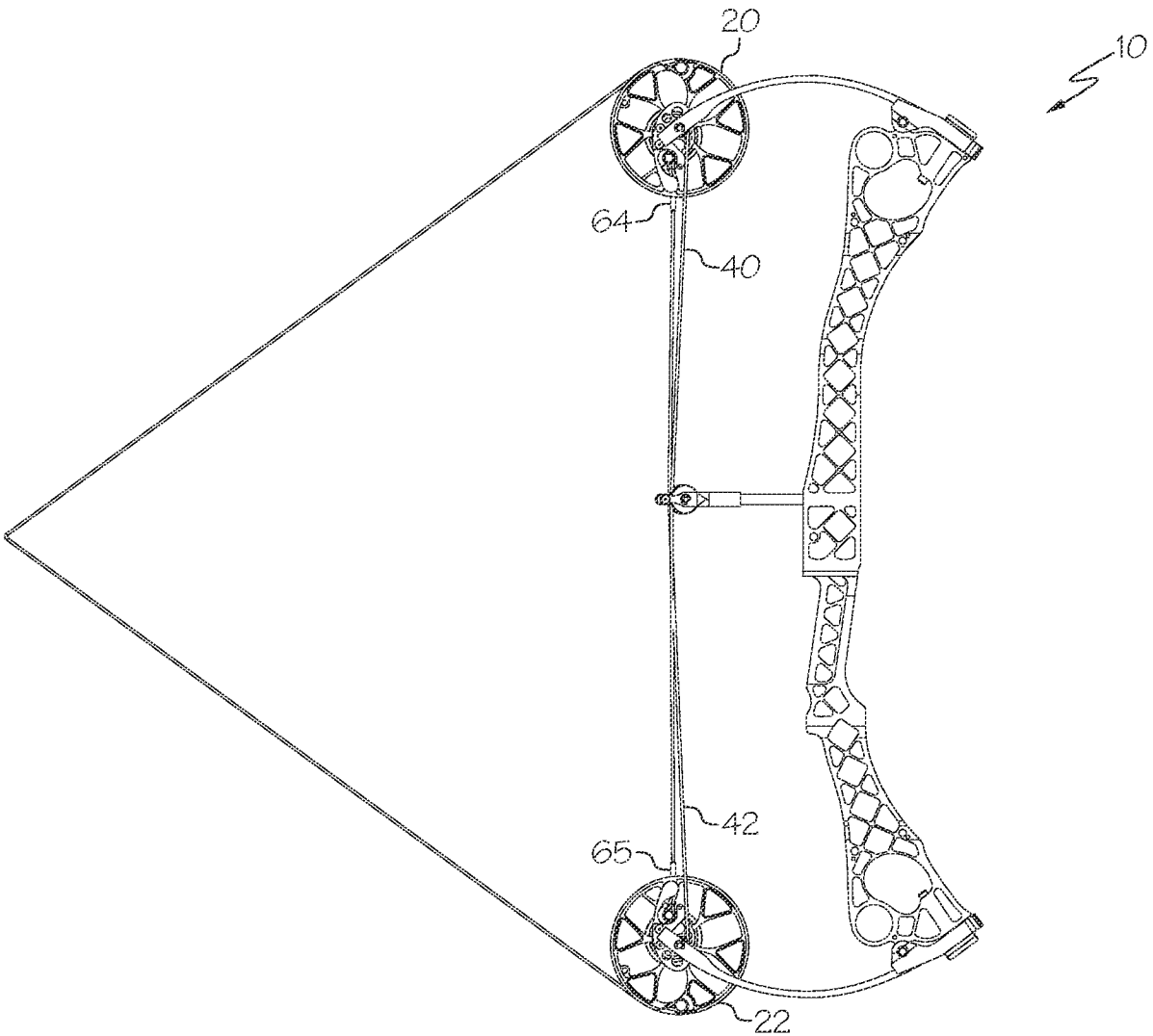
FIG. 3 shows the bow of FIG. 1 in a drawn condition.

FIG. 3 shows the bow 10 of FIG. 1 at full draw. As the bow 10 is drawn, a rotatable member 20 might contact a cable 42 at varying locations along a length of the cable 42. In some embodiments, a protector 64 has a length sufficient to protect an entire portion of the cable 42 that might contact the rotatable member 20. In some embodiments, multiple protectors 64 can be used adjacent to one another along a length of a cable 42.

Figure 4:
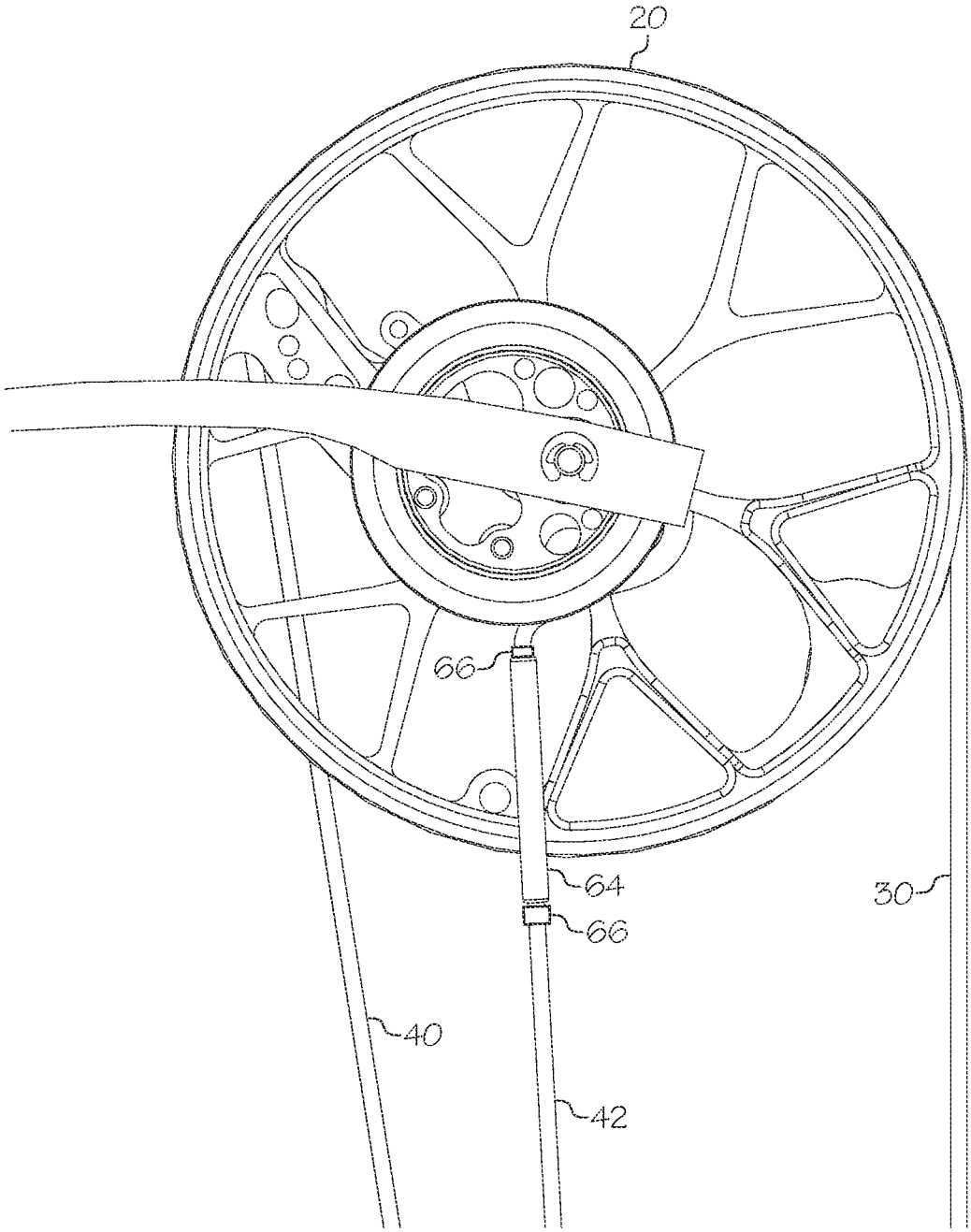
FIG. 4 shows an embodiment of a rotatable member in a brace condition.
Figure 5:
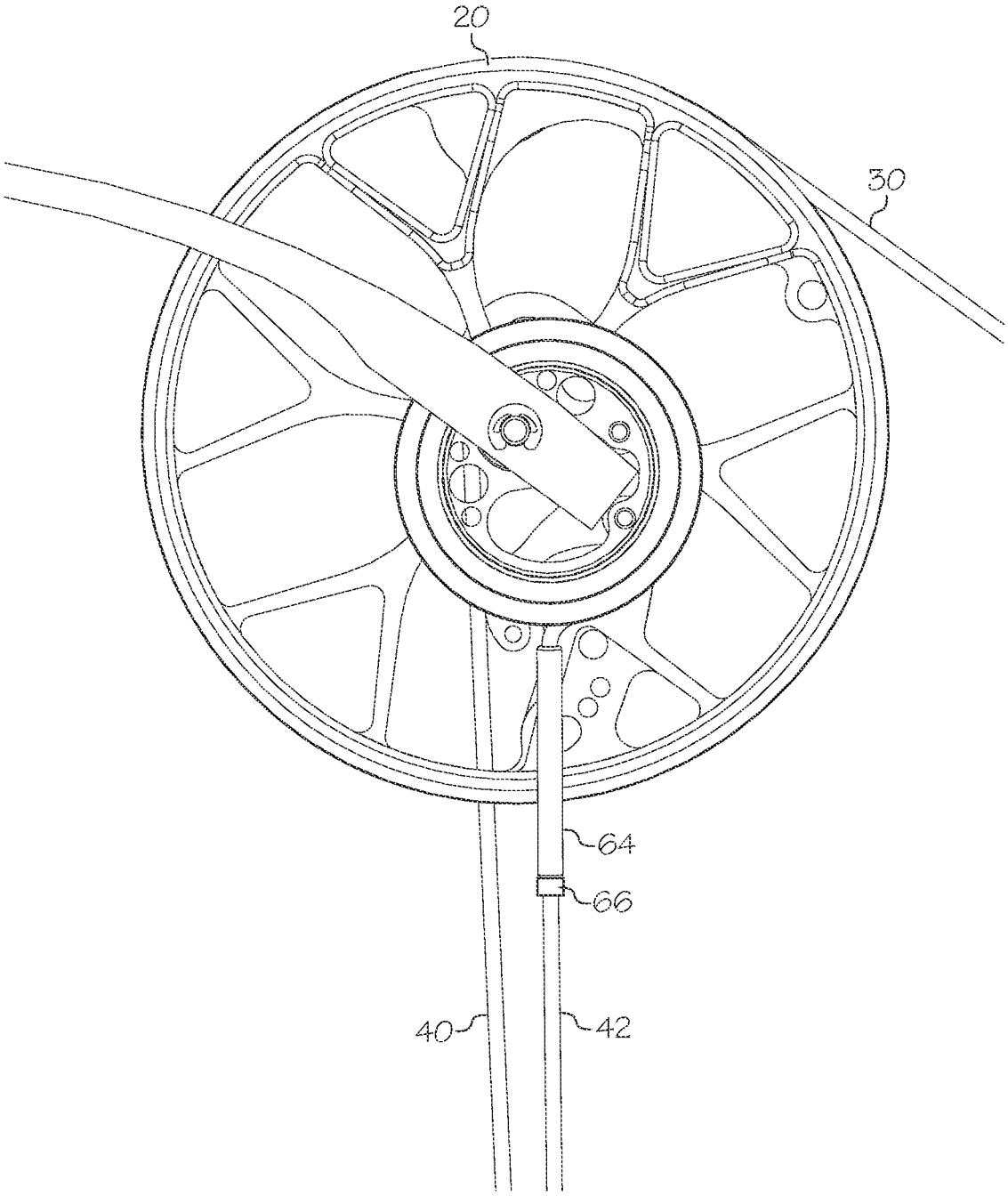
FIG. 5 shows the rotatable member of FIG. 4 in a drawn condition.

FIGS. 4 and 5 show an embodiment of a rotatable member 20 of a bow in respective brace and drawn conditions.

In some embodiments, a protector 64 comprises a tubular member that fully surrounds a cable 42. In some embodiments, a protector 64 is arranged to rotate about an axis of the cable 42. In some embodiments, a protector 64 comprises a roller. In some embodiments, a protector 64 comprises an arcuate outer surface. In some embodiments, a protector 64 comprises a circular outer surface. In some embodiments, a protector 64 comprises a circular cross-section. A rotatable or rolling protector 64 can distribute wear about its periphery. In some embodiments, as the bow transitions from brace to drawn conditions, the protector 64 rolls along the rotatable member 20 and protects the cable 42 from wear.

In some embodiments, a protector 64 defines an inner diameter that is larger than an outer diameter of a cable 42. This allows the protector 64 to rotate easily upon the cable 42.

In some embodiments, one or more anchor(s) 66 prevent the protector 64 from translating along a length of the cable. In some embodiments, multiple anchors 66 are used to prevent the cable protector 64 from translating, for example being located at each end of the protector 64. In some embodiments, an anchor 66 is attached to the cable 42. In some embodiments, the anchor 66 comprises a serving material. In some embodiments, the anchor 66 comprises a nock set. In some embodiments, the protector 64 can comprise an anchoring mechanism, for example comprising a clip that causes either the protector 64 or the clip to engage the cable (e.g. via friction).

A protector 64 can comprise any suitable material. In some embodiments, a protector 64 comprises one or more polymers, one or more metals, a composite material or any other suitable material. In some embodiments, a protector 64 comprises a low friction material, such as PTFE.

In some embodiments, a protector 64 comprises a replaceable component.

Figure 6:
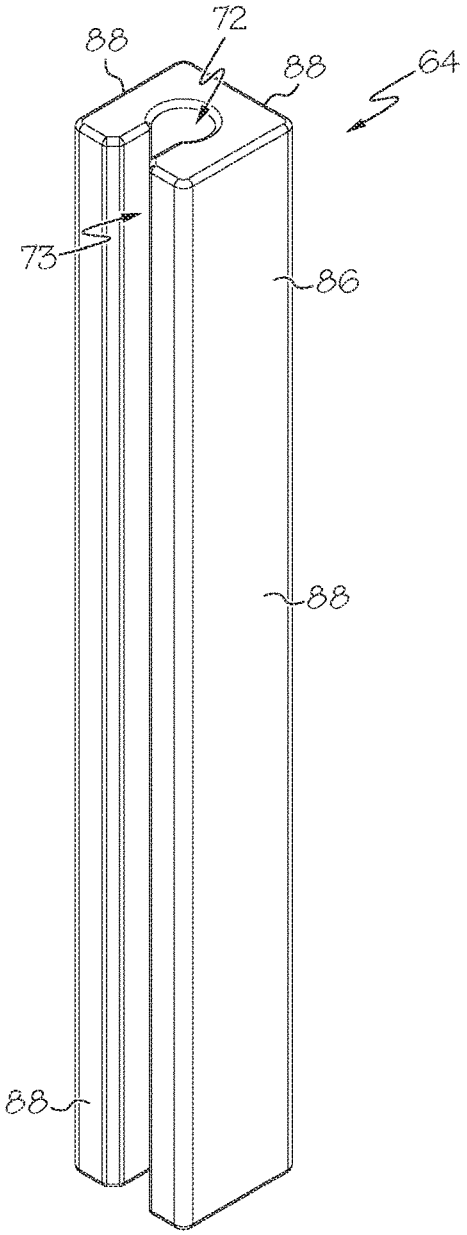
FIG. 6 shows an embodiment of a cable protector.
Figure 7:
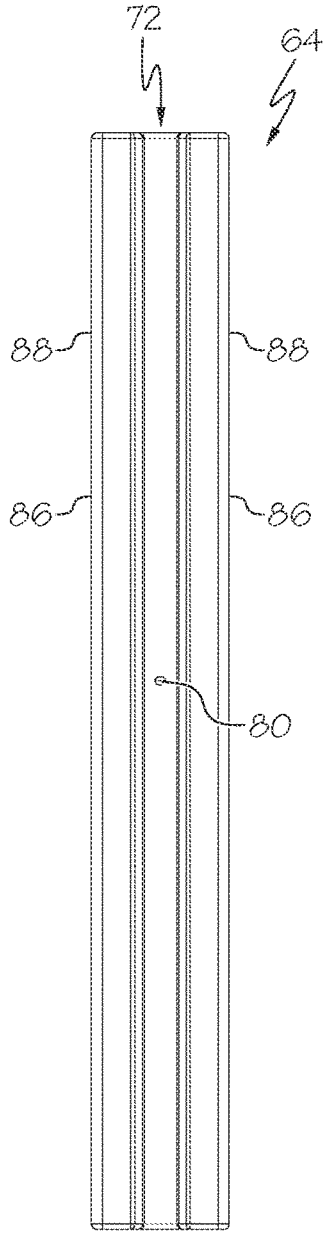
FIG. 7 shows a side view of the cable protector of FIG. 6.
Figure 8:
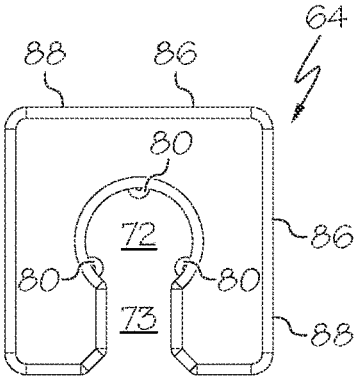
FIG. 8 shows a top view of the cable protector of FIG. 6.

FIGS. 6-8 show another embodiment of a protector 64.

In some embodiments, a protector 64 comprises a non-circular cross-sectional shape. In some embodiments, a protector 64 comprises an outer surface comprising one or more flat portions 86. In some embodiments, a flat portion 86 is arranged to contact an adjacent portion of a bow, such as a rotatable member. In some embodiments, a protector 64 remains fixed in position with respect to a cable 42 as the bow is drawn.

A protector 64 can have any suitable number of flat portions 86. In some embodiments, a protector 64 comprises a plurality of sides 88. In some embodiments, a side comprises one or more flat portions 86. A protector 64 can have any suitable number of sides 88. In some embodiments, each side 88 provides a separate wear surface that can be positioned against an adjacent portion of a bow, such as a rotatable member. If one side 88 develops visible wear, the protector 64 can be re-oriented on the cable 42 to place a different side 88 in contact with the rotatable member.

In some embodiments, a protector 64 comprises a cavity 72 and an opening 73 in communication with the cavity 72. In some embodiments, the opening 73 is continuous and extends an entire length of the protector 64. In some embodiments, the opening 73 allows the protector 64 to be attached to a cable of a strung bow without removing the cable or using any tools. In some embodiments, a protector 64 comprises a clip-on member arranged to engage a cable.

In some embodiments, a width of an opening 73 is less than a width or distance across a cavity 72. In some embodiments, a width of the opening 73 is less than a diameter of a cable upon which the protector 64 is mounted.

This allows the protector 64 to be installed upon a cable via resilient deformation of the protector 64 and/or the cable.

With reference to FIGS. 7 and 8, in some embodiments, a protector 64 comprises one or more protrusions 80 arranged to contact the cable that supports the protector 64. In some embodiments, one or more protrusions 80 are positioned within the cavity 72. In some embodiments, multiple protrusions 80 are equally spaced about a periphery of the cavity 72. In some embodiments, multiple protrusions 80 are equally spaced about a central axis of the cavity 72.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow having a brace condition and a drawn condition, the archery bow comprising:

a rotatable member arranged to rotate about an axis;

a bowstring attached to the rotatable member and extending away from the rotatable member;

a cable attached to the rotatable member and extending away from the rotatable member, the cable comprising a cable segment located adjacent to the rotatable member; and a protector comprising a body comprising a cavity the body comprising a lateral opening into the cavity, the lateral opening extending an entire length of the protector, the cable segment extending through the cavity, the body supported only by the cable segment, at least a portion of the body located between the cable segment and the rotatable member in at least the brace condition, a distance between the axis and a first end of the protector being less than a distance between the axis and an outer periphery of the rotatable member, wherein a distance between the axis and a second end of the protector is greater than the distance between the axis and the outer periphery of the rotatable member.

2. The archery bow of claim 1, wherein the protector contacts the rotatable member during at least a portion of a draw cycle.

3. The archery bow of claim 1, wherein the protector contacts the rotatable member in the brace condition.

4. The archery bow of claim 1, wherein the protector is fixedly attached to the cable segment.

5. The archery bow of claim 1, wherein the protector is frictionally engaged with the cable segment via resilient deformation.

6. The archery bow of claim 1, wherein the protector is arranged to rotate upon the cable segment.

7. The archery bow of claim 1, comprising an anchor attached to the cable segment adjacent to the protector.

8. The archery bow of claim 1, wherein the body fully surrounds the cable segment.

9. The archery bow of claim 1, wherein the body partially surrounds but does not fully surround the cable segment.

10. The archery bow of claim 1, the protector comprising an arcuate outer surface.

11. The archery bow of claim 10, the protector comprising a circular outer surface.

12. The archery bow of claim 1, the protector comprising a plurality of flat sides.

13. The archery bow of claim 1, wherein a width distance across the lateral opening is less than a width distance across the cavity.

14. The archery bow of claim 1, the protector comprising a first aperture into the cavity and a second aperture into the cavity, the first aperture located in the first end, the second aperture located in a second end, the cable segment extending continuously from the first end to the second end.

15. The archery bow of claim 14, the protector comprising a third opening into the cavity, the third opening extending an entire length of the protector.

16. The archery bow of claim 1, the protector comprising PTFE.

17. The archery bow of claim 1, wherein at least a portion of the body is located between the cable segment and the rotatable member in the drawn condition.

18. An archery bow comprising:

a riser;

a first limb supporting a first rotatable member arranged to rotate about an axis;

a second limb supporting a second rotatable member;

a bowstring extending between said rotatable members;

a cable attached to the first rotatable member, the cable comprising a cable segment located laterally adjacent to the first rotatable member; and a protector comprising a body comprising a first end, a second end and a length, the body comprising a cavity extending the length of the body, the body comprising a first aperture into the cavity and a second aperture into the cavity, the first aperture located in the first end, the second aperture located in the second end, the body frictionally engaging said cable segment and supported only by said cable segment, the cable segment extending continuously through the first aperture, the cavity and the second aperture, at least a portion of the body oriented between the cable segment and the first rotatable member, the protector comprising a low friction material a distance between the axis and a first end of the protector being less than a distance between the axis and an outer periphery of the rotatable member and wherein a distance between the axis and a second end of the protector is greater than the distance between the axis and the outer periphery of the rotatable member.

19. The archery bow of claim 18, wherein the cable segment comprises a power cable.

20. The archery bow of claim 18, the protector comprising a third opening into the cavity, the third opening extending an entire length of the protector.

21. The archery bow of claim 18, the protector comprising a plurality of flat sides.

22. The archery bow of claim 18, the protector comprising PTFE.

* * * * *